US007975884B2

(12) United States Patent
Mathabel et al.

(10) Patent No.: US 7,975,884 B2
(45) Date of Patent: Jul. 12, 2011

(54) VENT TUBE FOR LIQUID CONTAINER

(75) Inventors: Richard R. Mathabel, Citrus Springs, FL (US); Howard C. Chasteen, Westminster, CO (US); Mark A. Jacober, Arvada, CO (US); Alejandro J. Santamaria, Suwanee, GA (US); Andrew F. Clarke, Lower Burrell, PA (US)

(73) Assignee: Alcoa Inc., Pittsburgh, PA (US)

( * ) Notice: Subject to any disclaimer, the term of this patent is extended or adjusted under 35 U.S.C. 154(b) by 520 days.

(21) Appl. No.: 11/485,521

(22) Filed: Jul. 12, 2006

(65) Prior Publication Data

US 2008/0011786 A1 Jan. 17, 2008

(51) Int. Cl.
*B65D 47/10* (2006.01)

(52) U.S. Cl. ..... 222/541.9; 222/478; 220/271; D9/438

(58) Field of Classification Search ..... 222/478, 222/541.9, 479, 481, 481.5; 220/271, 268, 220/269, 270, 906; D9/438
See application file for complete search history.

(56) References Cited

U.S. PATENT DOCUMENTS

| | | | | |
|---|---|---|---|---|
| 1,062,118 | A * | 5/1913 | Ritten | 222/479 |
| 1,084,857 | A * | 1/1914 | Harris | 222/479 |
| 2,761,583 | A | 9/1956 | Morse | |
| 3,169,678 | A | 2/1965 | Wilkinson | |
| 3,262,611 | A | 7/1966 | Palmer | |
| D208,591 | S | 9/1967 | Bozek | |
| 3,362,569 | A | 1/1968 | Geiger | |
| 3,370,169 | A | 2/1968 | Bozek | |
| 3,416,699 | A * | 12/1968 | Bozek | 220/271 |
| 3,434,622 | A | 3/1969 | Czegledy | |
| 3,506,167 | A * | 4/1970 | Orr | 222/479 |
| 3,794,206 | A | 2/1974 | De Line et al. | |
| 3,982,657 | A | 9/1976 | Keller et al. | |
| 4,032,034 | A | 6/1977 | Willis | |
| 4,062,471 | A | 12/1977 | Perry | |
| 4,196,823 | A | 4/1980 | Madden et al. | |
| 4,205,760 | A | 6/1980 | Hasegawa | |

(Continued)

FOREIGN PATENT DOCUMENTS

RU 41452 U1 10/2004

(Continued)

OTHER PUBLICATIONS

Office Action relating to corresponding European Application No. 07 799 532.2-2308 dated Apr. 1, 2009, and including Written Opinion of International Searching Authority relating to corresponding International Application No. PCT/US07/073359, as referred to in the European Office Action.

(Continued)

*Primary Examiner* — Kevin P Shaver
*Assistant Examiner* — Donnell Long
(74) *Attorney, Agent, or Firm* — Greenberg Traurig, LLP

(57) ABSTRACT

The present invention provides a can lid having an air passage that focalizes air flow to the pour spout opening during pouring in a manner that provides a laminar flow without substantial surging. More particularly, the present invention provides a container including a can lid, a severable pour spout in the can lid, and at least one air passage integrated into the can lid extending from the severable pour spout by a dimension to provide a focused air flow to an interior of the container to a spout opening when severed.

12 Claims, 8 Drawing Sheets

U.S. PATENT DOCUMENTS

| | | | | |
|---|---|---|---|---|
| RE30,349 | E | 7/1980 | Silver | |
| D267,633 | S | 1/1983 | Christian | |
| 4,438,865 | A | 3/1984 | Scattaregia | |
| 4,494,681 | A | 1/1985 | Ueda et al. | |
| 4,523,699 | A * | 6/1985 | Branscum | 222/189.07 |
| 5,064,087 | A | 11/1991 | Koch | |
| D353,769 | S | 12/1994 | Miller | |
| 5,538,165 | A * | 7/1996 | Frohn | 222/479 |
| 5,555,992 | A * | 9/1996 | Sedgeley | 220/269 |
| 5,860,553 | A | 1/1999 | Schubert | |
| 5,897,035 | A * | 4/1999 | Schlomer | 222/479 |
| 5,911,311 | A | 6/1999 | Hutchins | |
| 5,979,697 | A | 11/1999 | Kim | |
| 6,079,583 | A * | 6/2000 | Chasteen | 220/269 |
| 6,354,453 | B1 | 3/2002 | Chasteen | |
| 7,000,797 | B2 * | 2/2006 | Forrest et al. | 220/269 |
| 2002/0014489 | A1 | 2/2002 | Anthony et al. | |
| 2002/0113069 | A1 | 8/2002 | Forrest et al. | |
| 2003/0080132 | A1 | 5/2003 | Forrest et al. | |
| 2003/0111469 | A1 | 6/2003 | Hartman et al. | |
| 2004/0099664 | A1 | 5/2004 | Hartman | |
| 2004/0144787 | A1 * | 7/2004 | Heck | 220/271 |
| 2005/0040130 | A1 * | 2/2005 | Bivens | 215/40 |
| 2005/0173437 | A1 | 8/2005 | Hwang | |

FOREIGN PATENT DOCUMENTS

| | | |
|---|---|---|
| WO | 00/37323 | 6/2000 |

OTHER PUBLICATIONS

International Search Report dated Nov. 16, 2007 relating to PCT International Application No. PCT/US2007/073359.

International Preliminary Report on Patentability, including Written Opinion of the International Searching Authority dated Jan. 13, 2009 relating to PCT International Application No. PCT/US2007/073359.

Chinese Office Action dated Jan. 8, 2010 from Chinese Application No. 200780026334.4.

Russian Office Action dated Feb. 2, 2010 from Russian Application No. 2009104690.

Canadian Office Action dated Feb. 8, 2010 from Canadian Application No. 2,657,391.

Australian Office Action dated Mar. 15, 2010 from Australian Application No. 2007272421.

European Office Action from European Application No. 07799532 dated Oct. 9, 2009.

* cited by examiner

SECTION A–A
(PROFILE EXAMPLES)

SECTION B–B
(PROFILE EXAMPLES)

VENT TUBE FOR LIQUID CONTAINER

FIELD OF THE INVENTION

This invention relates to beverage containers having a severable pour spout and more particularly pertains to a new beverage container lid having an air passage that enables faster pouring.

BACKGROUND OF THE INVENTION

A number of containers, such as beverage containers, are configured to achieve easy opening, such as without the need for a can opener or other tool and preferably do not involve separation of any parts. One design factor of some importance to consumers is the pour characteristics of the container. In general, consumers prefer to use containers capable of providing a relatively high pour rate.

Additionally, it is believed consumers prefer containers that provide a smooth pour, i.e. a pour which is not characterized by a series of surges (which can cause splashing and/or can affect a beverage head, fizz or other carbonation). An observable interruption or uneven flow occurs as the contents of the beverage container is being dispensed resulting in disruption in pressure equalization between the inside of the can and the ambient atmosphere with prior designs. Prior attempts to alleviate uneven flow characteristics required additional vent openings to be formed through the lid structure of the container. Other prior methods utilize specialized pour opening geometries. The additional vent openings and/or specialized pour opening geometries present design complexity, additional cost, and leakage concerns.

In light of the above, a need exists for a container opening that allows the atmosphere to replace the dispensed contents of the container and results in uninterrupted flow of the content being dispensed.

SUMMARY OF THE INVENTION

Generally speaking, in accordance with the present invention, a container is provided having an air passage within a container lid for equalizing atmosphere to replace the contents being dispensed from the container.

Broadly, in one embodiment of the present invention, a container is provided including:

a can lid atop a container, a severable pour spout in the can lid, and an air passage integrated into the can lid extending from the severable pour spout by a dimension to provide a focused air flow to the interior of the container when the severable pour spout is severed.

Once the seal of the pour spout is broken the contents of the container may be poured in a smooth flow, since the air passage allows for the ambient atmosphere to enter and occupy the space formerly occupied by the content of the container in an uninterrupted manner.

In one embodiment, the air passage is provided by a channel formed raised from the product side of the can lid in a direction towards the consumer side of the can lid. In another embodiment, the air passage is provided by the combination of a raised channel and a membrane extending the length of the raised channel. In a further embodiment, the air passage is provided by tube positioned within the raised channel formed in the container lid extending from the severable pour spout.

In another aspect of the present invention, a container is provided having an air passage fixed to the product side of the can lid. Broadly, the container includes:

a can lid atop a container, a severable pour spout in the can lid, and an air passage fixed to the product side of the container lid extending from the severable pour spout by a dimension to provide a focused air flow to the interior of when the severable pour spout is severed.

In a one embodiment, the air passage that is fixed to the container lid is provided by a tube positioned on the product side of the can lid.

In another aspect of the present invention a can lid is provided including:

a severable pour spout, and at least one air passage integrated into the can lid from the severable pour spout by a dimension to provide a focused air flow to a container body to which the container lid is engaged.

In one embodiment, the can lid may be reversibly engaged to the container body.

BRIEF DESCRIPTION OF THE DRAWINGS

The following detailed description, given by way of example and not intended to limit the invention solely thereto, will best be appreciated in conjunction with the accompanying drawings, wherein like reference numerals denote like elements and parts, in which.

DETAILED DESCRIPTION OF PREFERRED EMBODIMENTS

Figure 1A:
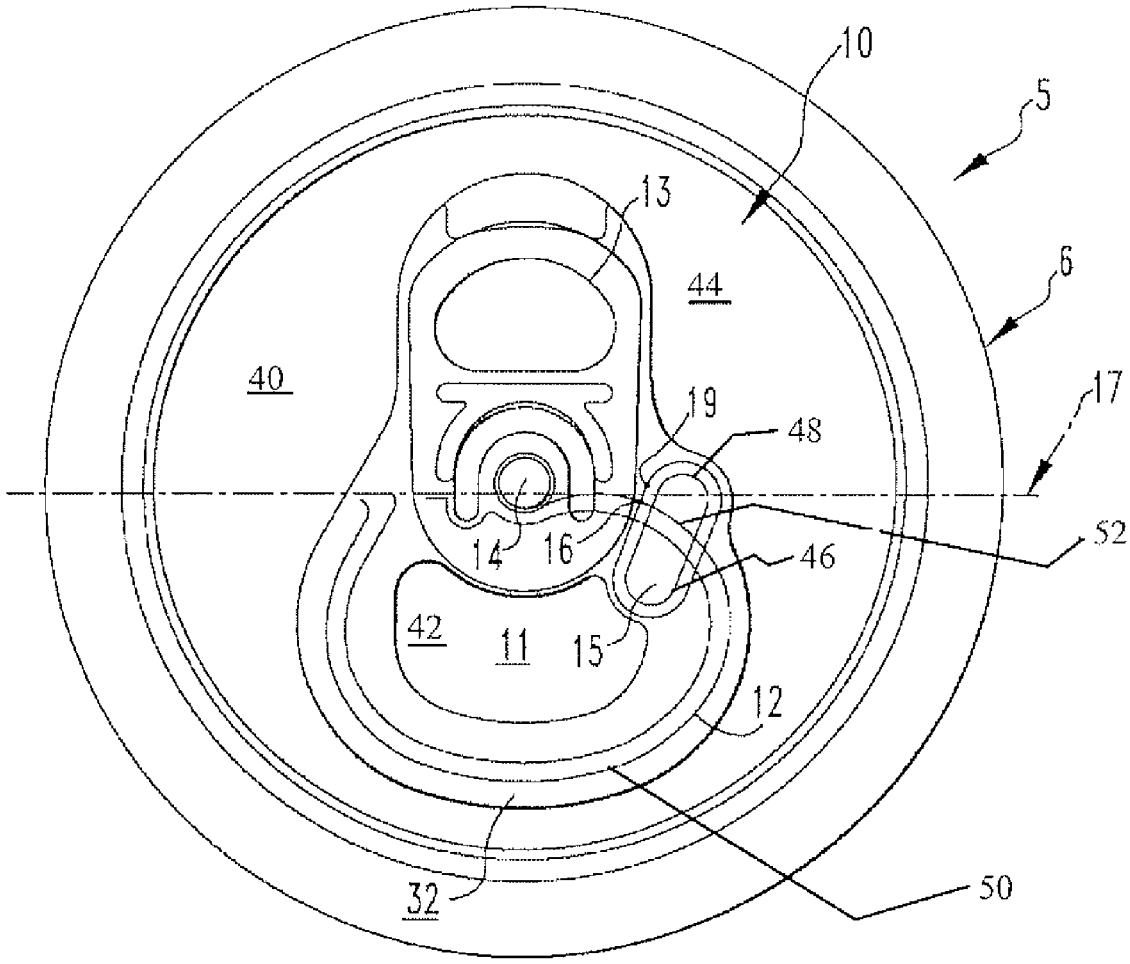
FIG. 1A is a top view of a beverage container having one embodiment of a can lid in accordance with the present invention.

FIG. 1A is a top view of one embodiment of a container 5 including a can lid 10 with an air passage 15 in accordance with the present invention. Although it is preferred that the container body 6 and can lid 10 are composed of aluminum, other materials, such as steel and plastic, have been contemplated and are within the scope of the present invention. Although FIG. 1A depicts a container having a permanently fixed lid, the present invention is applicable to container lids that may be reversibly engaged to a container body.

Methods of forming container bodies 6 and the attachment or coupling of the container lid 10 are known. The severable pour spout 11 incorporated into the container lid 10 (also referred to as can lid) is provided by forming a score line 12 within a substantially planar center portion 40 of the can lid 10. The substantially planar center portion 40 lies in a plane and has a consumer side and a product side. The score line 12 may be formed by stamping with a die or "knife" to define a pour opening area 42. A non-pour opening area 44 is adjacent to the pour opening area 42 and lying in the same plane as the planar center portion 40. The score line 12 has a first portion 50 lying in the same plane as the planar center portion 40 and a second portion 52 raised from the planar center portion in the direction of the consumer side. A tab 13 is coupled to the can lid 10 e.g. by a rivet 14 whose center defines a pivot point. The can lid 10 of the present invention may be inscribed or embossed with any design or lettering.

Generally, lifting the upper edge of the tab 13 up and towards the severable pour spout 11 results in the forward edge of the tab 13 pressing downward (e.g. with respect to the rivet 14) on part of the severable pour spout 11 with sufficient force to cause a rupture to form along the score line 12, permitting the severable pour spout 11 to bend or pivot inward providing a pour spout opening. Once the severable pour spout 11 of the can lid 10 has been pivoted inward the can lid 10 has an opening whose perimeter is defined by the score line 12.

One aspect of the present invention is a focused air passage from the exterior of the container to the interior of the container that facilitates pouring of liquid contents. In the container 5 depicted in FIG. 1A, a can lid 10 is provided having an air passage extending from a severable pour spout 11 by a dimension sufficient to provide a focused air flow from the exterior of the container to the container's interior. For the purposes of this disclosure, the term "dimension to provide a focused airflow" denotes a distance from a point 16 on the score line corresponding to the portion of pour spout 11 at which the air passage 15 begins to at least a point 19 that is positioned beyond a plane 17 tangent to the uppermost portion of the pour spout. In one embodiment, the air passage provides that the contents of the container 5 may be poured in a smooth uninterrupted flow, since the air passage 15 allows for the ambient atmosphere to enter and occupy the space formerly occupied by the content of the container in an uninterrupted manner. Preferably, the air passage extends from a portion of the severable pour spout 11 opposite a pouring portion 32 of the spout opening.

Figure 1B:
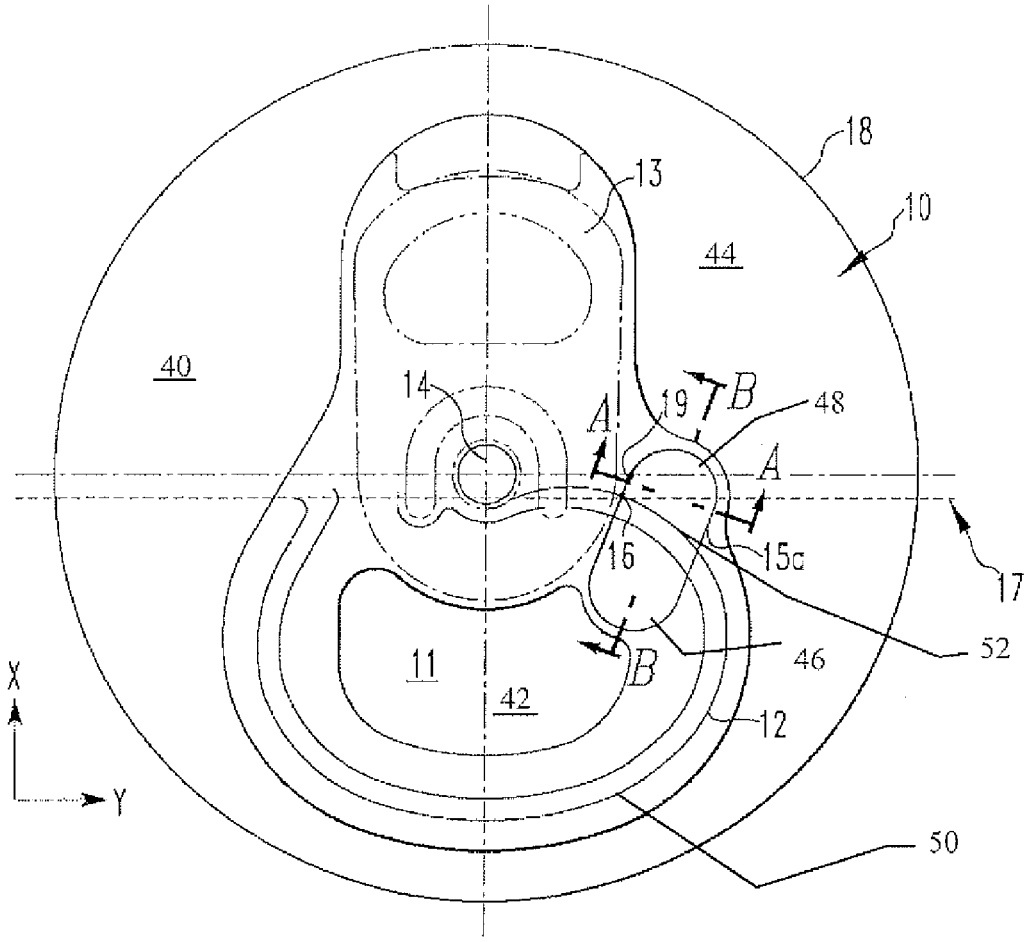
FIG. 1B is a top view of the consumer side of a can lid with an air passage provided by one embodiment of a raised channel in accordance with the present invention.

FIG. 1B is a top view of the consumer side of a can lid 10 with an air passage providing a channel 15*a* that is integrated into the substantially planar center portion 40 of the can lid 10. A first end 46 of the channel 15*a* is located on and raised from the pour opening area 42. A second end 48 of the channel 15*a* is located on and raised from the non-pour opening area 44. The consumer side of the can lid 10 is the can lid's exterior face. The channel 15*a* may be integrated into the can lid 10 as a raised channel, wherein the upper portion of the channel 15*a* is raised relative to the adjacent portions of the can lid's upper surface. It is noted that the height of the raised channel 15*a* provides that an air passage is present when the container is tilted during pouring so that the liquid level reaches the plane 17 tangent to the uppermost portion of the pour spout. In one embodiment, the raised channel 15*a* may have a generally oblong geometry with a substantially linear orientation.

Figure 1C:
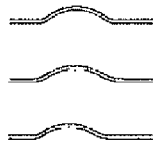
FIG. 1C is a cross-sectional view of the raised channel along section line A-A of FIG. 1B.
Figure 1D:
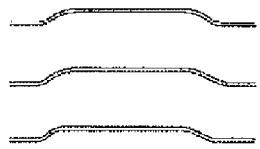
FIG. 1D is a cross-sectional view of the raised channel along section line B-B of FIG. 1B.

FIG. 1C depicts the cross section of embodiments of the raised channel 15*a* depicted in FIG. 1B along section line A-A. FIG. 1D depicts the cross section of embodiments of the raised channel 15*a* depicted in FIG. 1B along section line B-B. It is noted that the cross sections in FIGS. 1C and 1D are illustrative examples and that the invention is not limited thereto, as other orientations and geometries have been contemplated and are within the scope of the present invention. For example, alternative cross sections may have a flat, round, or peaked upper surface.

In a preferred embodiment, the raised channel 15*a* extends from a portion of the severable pour spout 11 in the can lid 10 across a score line 12 defining the severable pour spout 11 to at least the dimension to provide a focused air flow. The dimensions and geometry of the raised channel 15*a* are preferably selected to provide an equalizing air passage, wherein the raised channel 15*a* focalizes the air intake point for the container to ensure that ambient air flows into the container to replace the volume that is being poured from the container without disruption. In another example, a raised channel 15*a* ends within approximately 0.125 inches from the can lid perimeter 18.

Figure 1E:
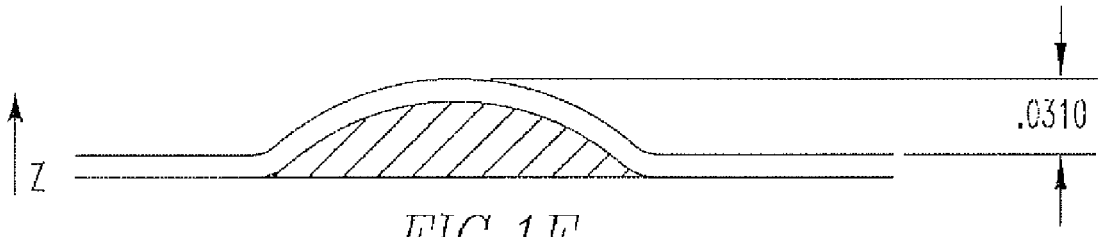
FIGS. 1E and 1F are cross-sectional views depicting the feature height of the raised channels depicted in FIGS. 1A-1D.
Figure 1F:
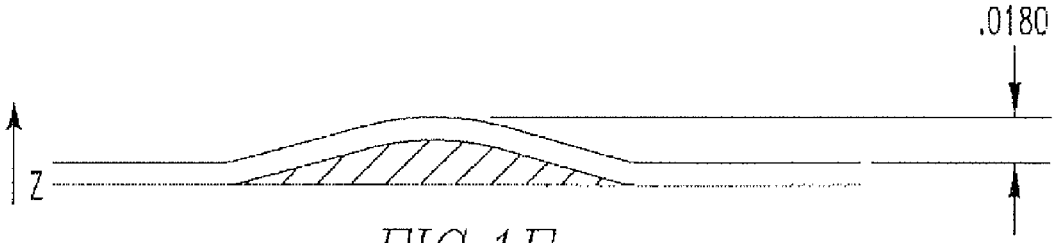
Figure 5:
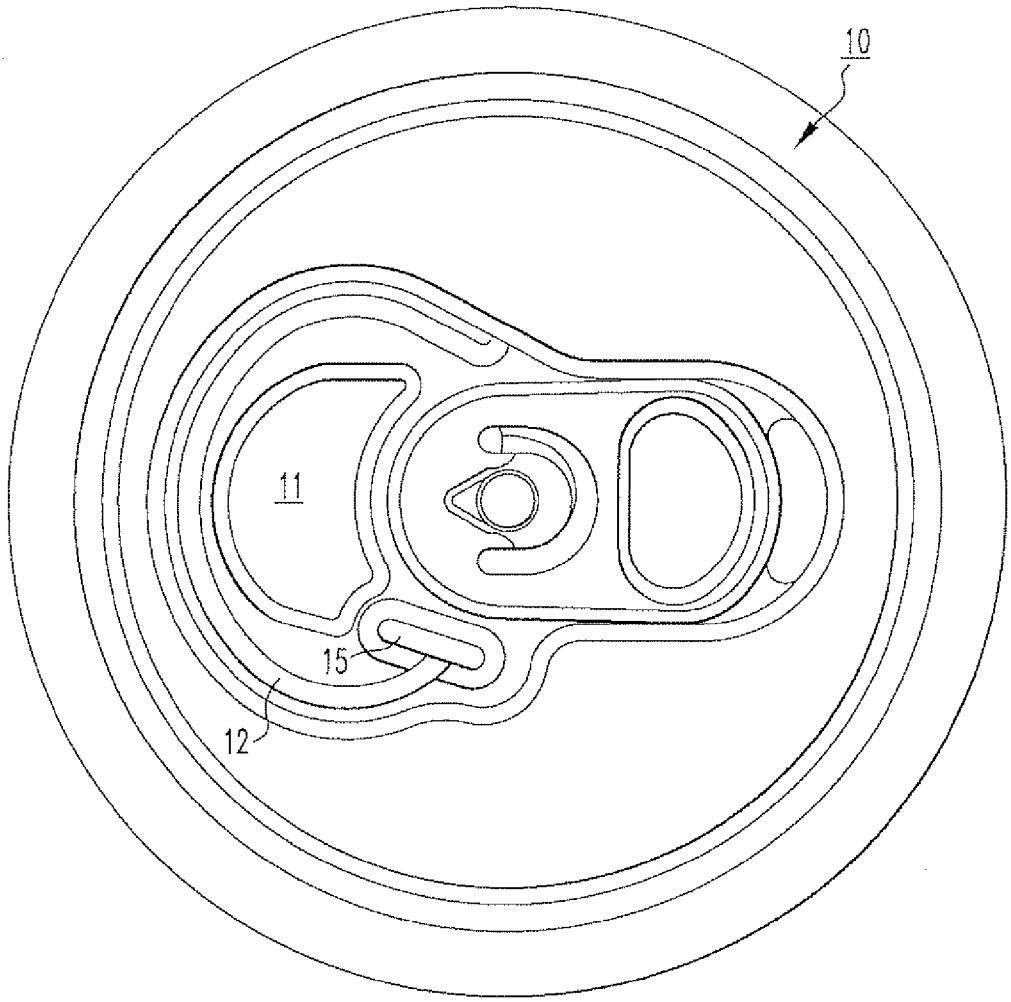
FIG. 5 is a photographic representation of a can lid with an air passage in accordance with the present invention.

In one embodiment, the raised channel 15*a* may be stamped into the can lid 10. The raised channel 15*a* may be raised a height ranging from about 0.001" to about 0.060" above the can lid's 10 upper surface, preferably being raised by a dimension ranging from about 0.007" to about 0.040". FIG. 1E depicts one preferred embodiment of a raised channel 15*a* having a height of approximately 0.0310" and a cross sectional area equal to approximately 0.0031 sq. inches. FIG. 1F depicts another preferred embodiment of a raised channel 15*a* having a height of approximately 0.0180" and an area equal to approximately 0.0017 sq. in. As depicted in FIG. 5, the raised channel 15*a* provides little disruption to the aesthetic appearance of the can lid 10.

Figure 1G:
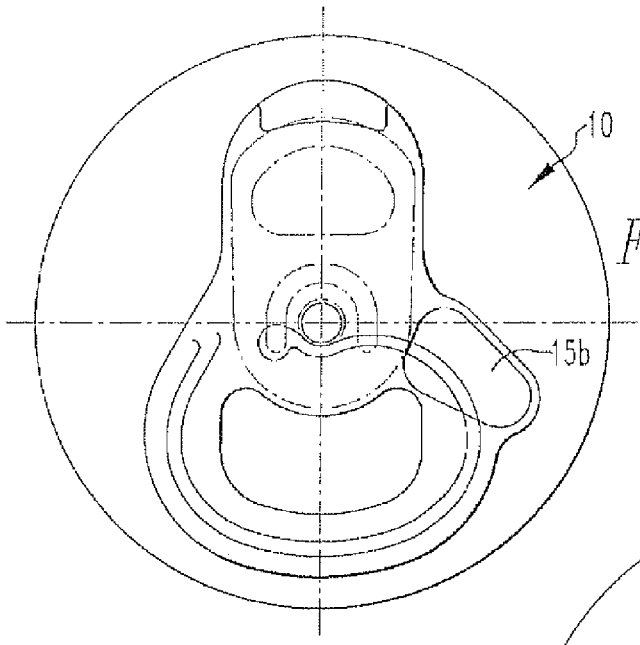
FIG. 1G is a top view of the consumer side of a can lid with an air passage provided by one embodiment of a triangular raised channel in accordance with the present invention.
Figure 1H:
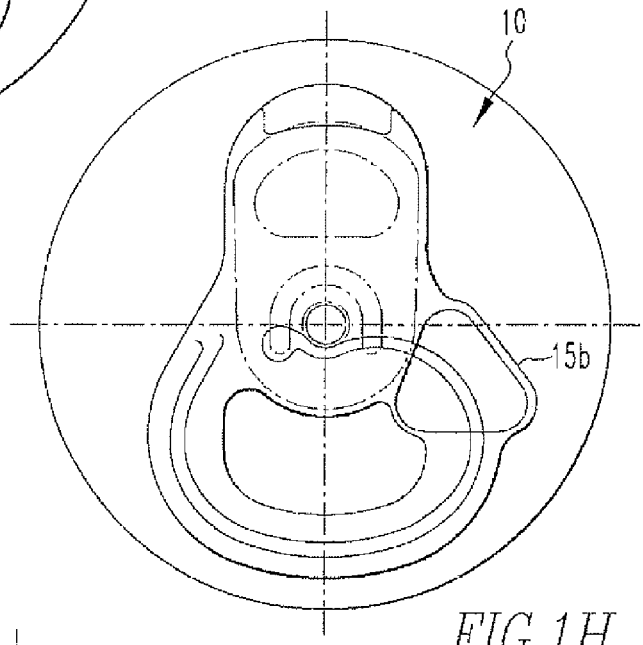
FIG. 1H is a top view of the consumer side of a can lid with an air passage provided by another embodiment of a triangular raised channel in accordance with the present invention.
Figure 1I:
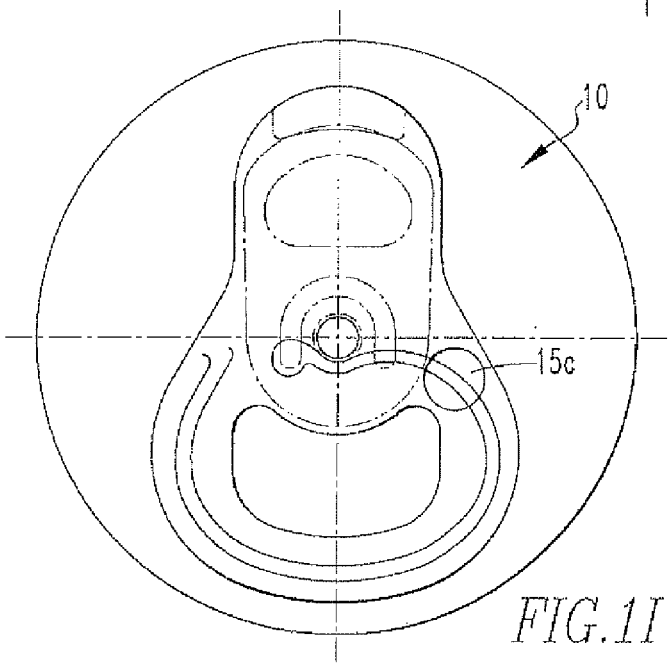
FIG. 1I is a top view of the consumer side of a can lid with an air passage provided by an embodiment of a circular raised channel in accordance with the present invention.

Although, the preferred geometry of the raised channel 15*a* is substantially linear having an oblong shape, as depicted in FIGS. 1A and 1B, any geometry may be suitable for the raised channel 15*a*, so long as the geometry can provide a focused air passage from the exterior of the container to the container's interior and that the geometry does not substantially decrease the sealing integrity of the pour spout 11. It is noted that the geometry of the raised channel 15*a* may be symmetrical or non-symmetrical with respect to any of the container lid's axis, i.e. x-axis, y-axis and/or z-axis as depicted in FIGS. 1B, 1E, and 1F. FIGS. 1G and 1H depict embodiments of the consumer side of a can lid 10 wherein the raised channel has a triangular geometry 15*b*. FIG. 1I depicts one embodiment of the consumer side of a can lid 10 with an air passage provided by a circular raised channel 15*c*.

Figure 1J:
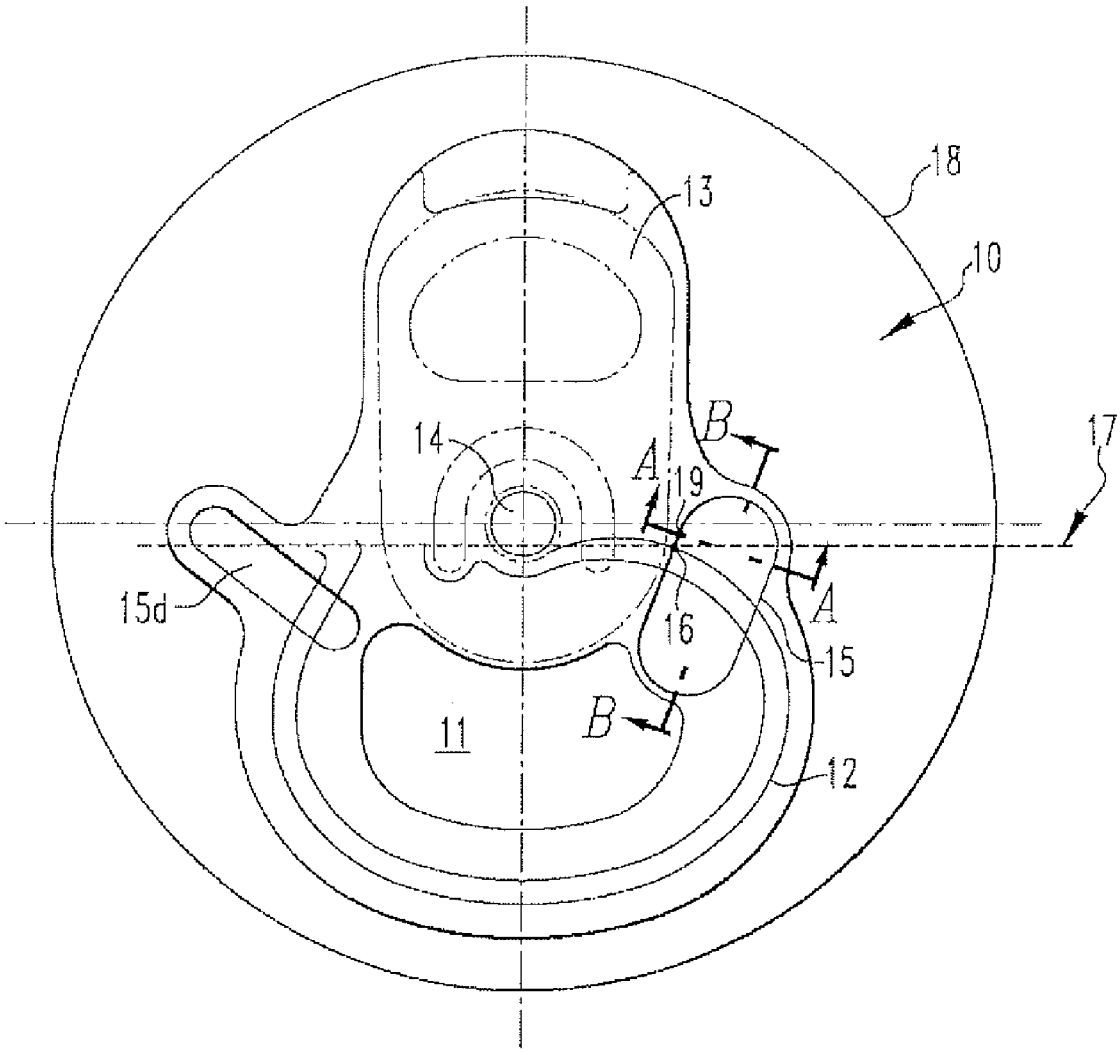
FIG. 1J is a top view of the consumer side of one embodiment of a can lid with two air passages integrated into the can lid in accordance with the present invention.
Figure 1K:
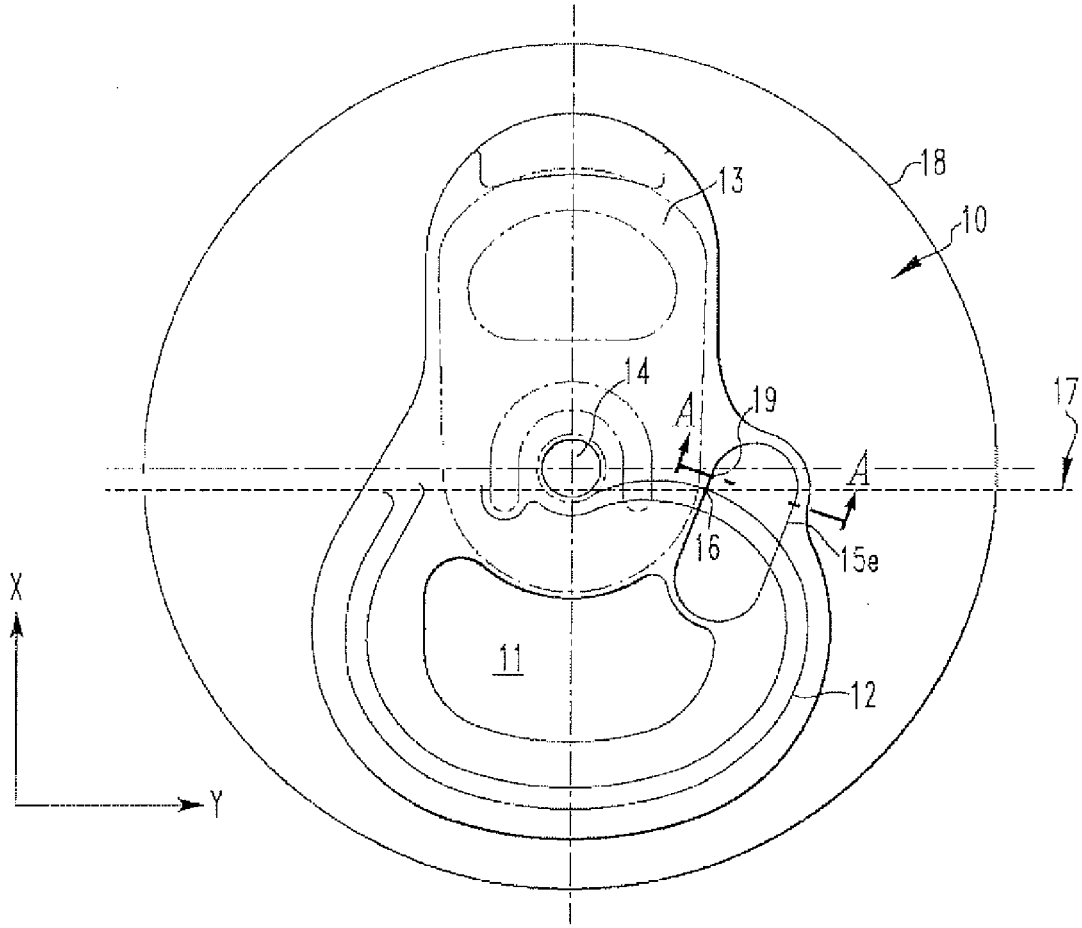
FIG. 1K is a top view of the consumer side of one embodiment of a can lid having a debossed air passage integrated into the can lid in accordance with the present invention.
Figure 1L:
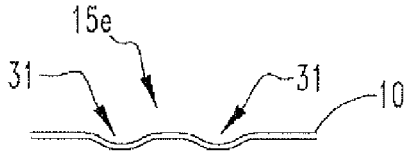
FIG. 1L is a cross-sectional view of the debossed channel along section line A-A of FIG. 1K.

FIG. 1J depicts one embodiment of the consumer side of a can lid 10 including two air passages 15, 15*d*, wherein each air passage may have any of the geometries described throughout the present disclosure. It is noted that although two air passages are depicted that any number of air passages may be integrated into the can lid 10 and are within the scope of the present disclosure. Referring to FIGS. 1K and 1L, alternatively, as opposed to a raised channel, the air passage may be provided by a debossed channel 15*e*. A debossed channel 15*e* is provided by recessing the adjacent portions 31 of the can lid 10 to the air passage. It is noted that the above geometries and dimensions described above with respect to the raised channel are equally applicable to the debossed channel 15*e*.

Figure 2:
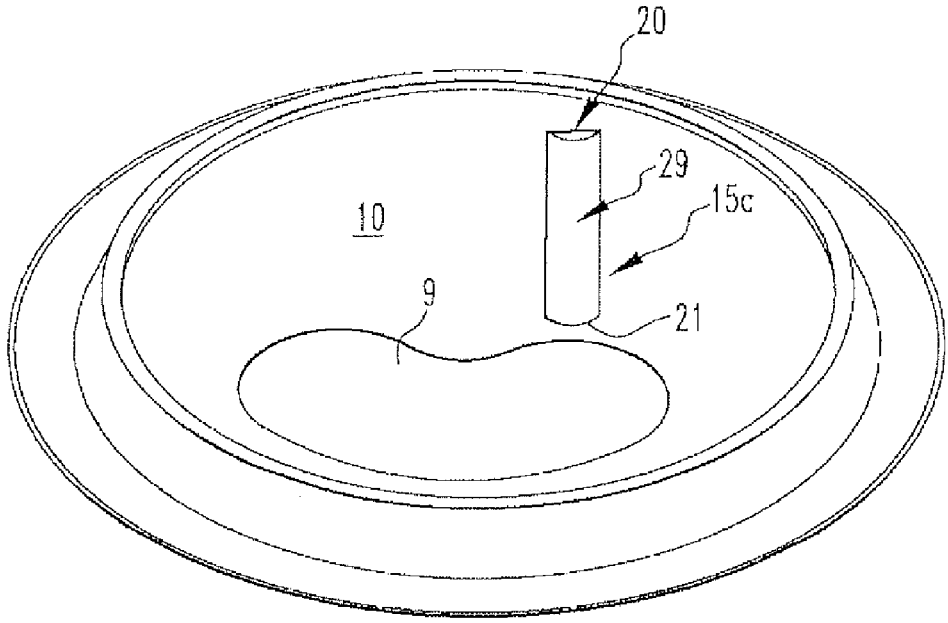
FIG. 2 is a perspective view of one embodiment of the product side of a can lid with an air passage provided by the combination of a raised channel and a membrane in accordance with the present invention.

FIG. 2 is a perspective view of the product side of another embodiment of the present invention, in which an air passage is provided by the combination of a raised channel 15*a* and a membrane 29. The product side of the can lid 10, or interior face of the can lid 10, is the face of the lid that may come in contact with the contents that are sealed within the container. It is noted that for the purposes of simplicity the can body, tab, severable pour spout and rivet are not depicted. The membrane 29 extends along the length of the raised channel 15*a* providing a first opening 21 in close proximity to the pour opening 9 and a second opening 20 beyond a dimension to provide a focused air flow from the exterior to the interior of the container 5, wherein the second opening 20 may be in close proximity to the can lid perimeter 18. The membrane 29 may be composed of a tape or an adhesively fixed polymer.

Figure 3:
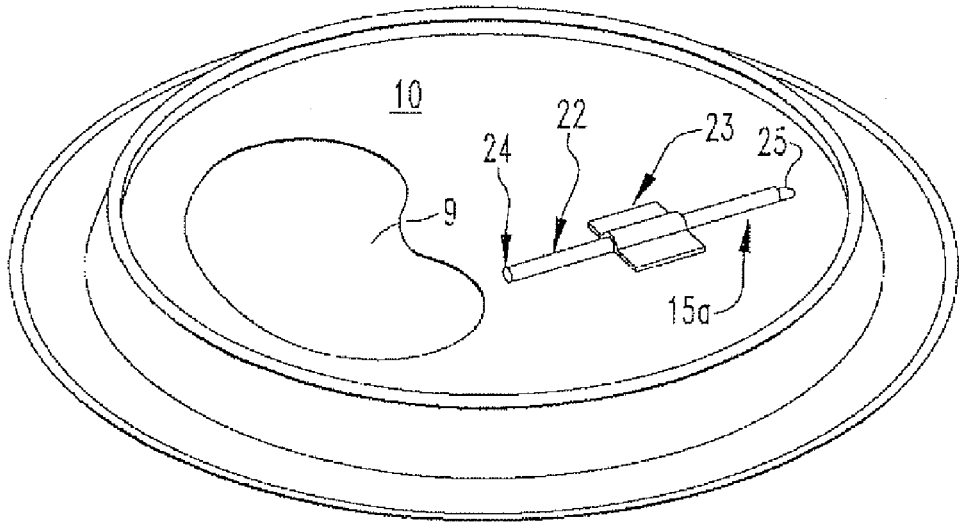
FIG. 3 is a perspective view of one embodiment of the product side of a can lid with an air passage provided by a raised channel and tube in accordance with the present invention.

FIG. 3 depicts the product side of another embodiment of a can lid in accordance with the present invention, in which an air passage is provided by the combination of a raised channel 15*a* and tube 22. The tube 22 may be adhesively fixed to the product side of the can lid 10 by tape 23 or adhesive glue; or may be fixed to the product side of the can lid 10 by frictional engagement to the raised channel 15*a*. It is noted that other methods for fixing the tube 22 to the can lid 10 have been contemplated and are within the scope of the present disclosure.

The tube 22 may extend along the length of the raised channel 15*a* and provide a first tube opening 24 in close proximity to pour spout opening 9 and a second tube opening 25 beyond a dimension to provide a focused air flow from the exterior to the interior of the container, wherein the second tube opening 25 may be in close proximity to the can lid perimeter 18. Although the tube 22 may preferably be composed of a polymer material, the tube 22 may alternatively be a metal.

Figure 4:
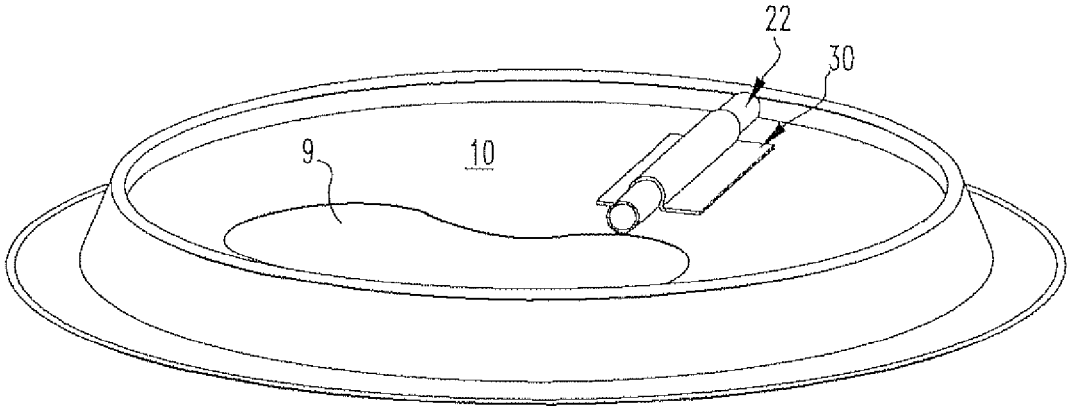
FIG. 4 is a perspective view of one embodiment of the product side of a can lid with an air passage provided by a tube in accordance with the present invention.

FIG. 4 is a perspective view of one embodiment of the product side of a can lid 10 with an air passage provided by a tube 22 without a raised channel. The tube 22 may be adhesively fixed, i.e. tape 30, to the product side of the can lid 10 without forming a raised channel. In this embodiment, the tube 22 may be utilized to provide an air passage to existing can lid designs. Additionally, fixing the tube 22 directly to the product side of the can lid without forming a raised channel does not affect the aesthetic qualities of the can lid's consumer side.

In each of the above embodiments, the air passage 15 extends from the severable pour spout 11 to a portion of the can lid 10 to provide a focused airflow. For the purposes of this disclosure, the term focused airflow denotes an equalizing atmosphere introduced by the end of the air passage corresponding to the score line of the severable pour spout 11, wherein the equalizing atmosphere enters and replaces the space formerly occupied by the content of the container in an uninterrupted matter so that the contents of the container may be poured in a laminar flow. Laminar flow, also referred to as streamline flow, is when a fluid flows in parallel layers, with no disruption between the layers. It is the opposite of turbulent flow.

The present invention, by focalizing the container's air intake point improves pouring time by up to 20% when compared to prior designs not including the inventive air passage.

The inventive air passage further reduces or eliminates pour surging by providing an uninterrupted flow of equalizing atmosphere.

A further advantage of the present invention is a substantial reduction or elimination in splashing when opening the container lid, particularly in nitrogen filled pasteurized products.

Although the invention has been described generally above, it is not intended that the invention be limited to the specific examples disclosed.

Having described the presently preferred embodiments, it is to be understood that the invention may be otherwise embodied within the scope of the appended claims.

What is claimed is:

1. A beverage container comprising:

a container lid atop a container, the container lid comprising:

a substantially planar center portion, lying in a plane, the substantially planar center portion comprising:

a product side;

a consumer side;

a first portion of a severable score line, the first portion lying in the same plane as the planar center portion;

a pour opening area defined by and within the severable score line and lying in the same plane as the planar center portion, wherein, when the score line is severed, the pour opening allows a flow of fluid; and a non-pour opening area adjacent to the pour opening and lying in the same plane as the planar center portion; and a channel integrally formed in the substantially planar center portion and raised from the plane of the substantially planar center portion in a direction of the consumer side, the channel comprising:

a first end located on and raised from the pour opening area;

a second end located on and raised from the non-pour opening area; and a second portion of the severable score line raised from the planar center portion in the direction of the consumer side;

wherein the channel extends continuously across the second portion of the severable score line.

2. The container of claim 1, wherein the channel has a linear orientation.

3. The container of claim 2, wherein the channel has a substantially oblong geometry.

4. The container of claim 1, further comprising a membrane extending a length of the channel having a first opening in close proximity to the severable score line and a second opening beyond a dimension configured to provide a focused air flow to the interior of the container.

5. The container of claim 4, wherein the membrane comprises a tape or an adhesively fixed polymer membrane.

6. The container of claim 1, wherein the channel has a circular or triangular geometry.

7. The container of claim 1, wherein the channel comprises a height ranging from 0.001" from 0.060".

8. The container of claim 1, comprising a tube disposed within the channel.

9. The container of claim 1, wherein the channel extends from the pour opening area in the container lid across the severable score line to at least the dimension configured to provide a focused air flow.

10. The container of claim 1, wherein the container lid comprises a metallic or polymer material.

11. The container of claim 1, wherein the container lid comprises aluminum.

12. A beverage container lid comprising:

a substantially planar center portion, lying in a plane, the substantially planar center portion comprising:

a product side;

a consumer side;

a first portion of a severable score line, the first portion lying in the same plane as the planar center portion;

a pour opening area defined by and within the severable score line and lying in the same plane as the planar center portion, wherein, when the score line is severed, the pour opening allows a flow of fluid; and a non-pour opening area adjacent to the pour opening and lying in the same plane as the planar center portion; and a channel integrally formed in the substantially planar center portion and raised from the plane of the substantially planar center portion in a direction of the consumer side, the channel comprising:

a first end located on and raised from the pour opening area;

a second end located on and raised from the non-pour opening area; and a second portion of the severable score line raised from the planar center portion in the direction of the consumer side;

wherein the channel extends continuously across the second portion of the severable score line.

* * * * *

UNITED STATES PATENT AND TRADEMARK OFFICE

CERTIFICATE OF CORRECTION

PATENT NO. : 7,975,884 B2
APPLICATION NO. : 11/485521
DATED : July 12, 2011
INVENTOR(S) : Richard R. Mathabel et al.

It is certified that error appears in the above-identified patent and that said Letters Patent is hereby corrected as shown below:

In claim 7, column 6, line 61, after "0.001", delete "from" and insert -- to --.

Signed and Sealed this
Twelfth Day of June, 2012

David J. Kappos

David J. Kappos
*Director of the United States Patent and Trademark Office*